United States Patent [19]

Hinata et al.

[11] 3,976,492

[45] Aug. 24, 1976

[54] SILVER HALIDE PHOTOGRAPHIC EMULSIONS

[75] Inventors: Masanao Hinata; Haruo Takei; Akira Sato; Tadashi Ikeda, all of Minami-ashigara, Japan

[73] Assignee: Fuji Photo Film Co., Ltd., Minami-ashigara, Japan

[22] Filed: July 25, 1975

[21] Appl. No.: 599,312

[30] Foreign Application Priority Data

July 25, 1974 Japan ..... 49-85519

[52] U.S. Cl. ..... 96/100; 96/124; 96/132

[51] Int. Cl.[2] ..... G03C 1/14; G03C 1/40

[58] Field of Search ..... 96/124, 132, 100

[56] References Cited

UNITED STATES PATENTS

| | | | |
|---|---|---|---|
| 2,089,323 | 8/1937 | Zeh | 96/132 |
| 2,701,198 | 2/1955 | Carroll et al. | 96/124 |
| 3,752,670 | 8/1973 | Needler et al. | 96/132 |
| 3,847,613 | 11/1974 | Sakazume et al. | 96/132 |

*Primary Examiner*—J. Travis Brown

*Attorney, Agent, or Firm*—Sughrue, Rothwell, Mion, Zinn and Macpeak

[57] ABSTRACT

A silver halide photographic emulsion containing at least one sensitizing dye represented by the formula (I)

(I)

wherein $Z_1$ represents a group of atoms necessary to complete a thiazole nucleus, a benzothiazole nucleus, a benzoselenazole nucleus, a naphthothiazole nucleus or a naphthoselenazole nucleus; $Z_2$ represents a group of atoms necessary to complete a naphthothiazole nucleus or a naphthoselenazole nucleus; and $R_1$ and $R_2$, which may be the same or different, each represents an aliphatic group and at least one of $R_1$ and $R_2$ is an aliphatic group containing a carboxyl group or a sulfo group; and at least one sensitizing dye represented by the formula (II)

(II)

wherein $Z_3$ and $Z_4$ which may be the same or different, each represents a group of atoms necessary to complete a thiazole nucleus, a benzothiazole nucleus or a benzoselenazole nucleus; and $R_3$ and $R_4$, which may be the same or different, each represents an aliphatic group and at least one of $R_3$ and $R_4$ is an aliphatic group containing a carboxyl group or a sulfo group.

17 Claims, 1 Drawing Figure

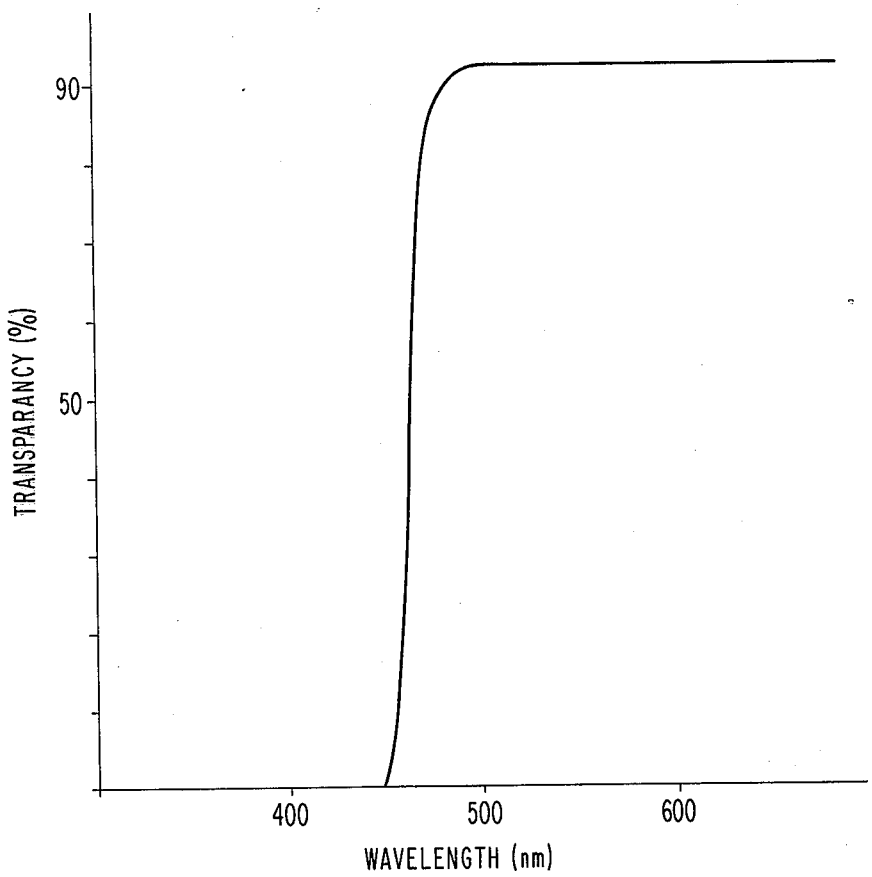
90
50
TRANSPARANCY (%)
400
500
600
WAVELENGTH (nm)

SILVER HALIDE PHOTOGRAPHIC EMULSIONS

BACKGROUND OF THE INVENTION

1. Field of the Invention

The present invention relates to spectrally sensitized silver halide photographic emulsions and particularly to silver halide photographic emulsions which are supersensitized by a novel combination of two sensitizing dyes.

2. Description of the Prior Art

It is well-known that the light-sensitive wavelength range of silver halide photographic emulsions can be expanded by addition of sensitizing dyes to achieve spectral sensitization. Although only one sensitizing dye is sometimes used in order to sensitize the silver halide photographic emulsion to the desired spectral sensitization wave-length, two or more sensitizing dyes are often used in combination. When two or more sensitizing dyes are used in combination, the degree of spectral sensitization often is intermediate the sensitization achieved using each sensitizing dye individually and sometimes is less than the sensitization using each sensitizing dye individually. However, when a specific combination of different sensitizing dyes is used, the degree of spectral sensitization sometimes marked by increases as compared with the case of using each sensitizing dye individually. Generally, this phenomenon is called supersensitization by the sensitizing dyes.

When such a combination is used, even though a spectral sensitization wavelength often is intermediate between or a mere combination value of the spectral sensitization wavelengths obtained using each sensitizing dye individually, a shift of the spectral sensitization to a wavelength which is not expected from the spectral sensitization achieved with each dye sometimes occurs.

Accordingly, an important subject in spectral sensitization techniques for silver halide photographic emulsions has been to discover combinations of sensitizing dyes which provide a higher spectral sensitivity than the sensitivity achieved using each sensitizing dye individually while having a sensitization wavelength range appropriate to the purpose of use of the photographic sensitive material.

In combining sensitizing dyes to achieve supersensitization, a strict selection of the dyes is required because a slight difference in the chemical structure of the dyes has a marked influence upon the supersensitization. Namely, prediction that super-sensitization will be achieved with a combination of sensitizing dyes is difficult by consideration of the mere chemical structure of the dyes.

The sensitizing dyes used in the supersensitization of silver halide photographic emulsions must not adversely interact with the other photographic additives and must have stable photographic properties during storage of the photosensitive materials.

Further, after processing the photosensitive materials, a residual color must not remain in the photosensitive materials containing the sensitizing dyes, particularly, a residual color must not be generated on processing the photosensitive materials for a short period of time (generally, about 3 to about 90 secons) such as in a rapid processing. A residual color is particularly not suitable for a photographic paper because a bright white color cannot be obtained in black-white photography and reproduction of true colors is impossible in color photography.

It is known (as disclosed in, for example, U.S. Pat. Nos. 3,752,670 and 3,480,434, German Patent Application (OLS) 2,303,204 and Japanese Pat. No. 30023/1971) to use sensitizing dyes in order to increase the sensitivity in the blue range. However, none of the sensitizing dyes used for sensitization in the blue range have sufficient photographic properties. Namely, simple merocyanine dyes as described in U.S. Pat. No. 3,480,434 and Japanese Pat. No. 30023/1971 have the defect that the spectral sensitivity distribution of the silver halide emulsion is broad and extends to a long wavelength side, and consequently a green range is sensitized. This disadvantage causes a deterioration of the color reproduction property in multilayer multicolor photosensitive materials. Although it is possible to somewhat decrease the sensitivity in the green range by providing a yellow filter on the blue-sensitive layer so as to overcome the above-described disadvantage, the sensitivity in the blue range decreases at the same time.

A certain type of monomethine cyanine dyes described in U.S. Pat. No. 3,752,670 and German Patent Application (OLS) 2,303,204 has the disadvantage of causing a high level of residual color, although this type of dye has a sharp J-band sensitization. Therefore, improved photographic emulsions wherein the longer wavelength side of the spectral sensitization range in the blue range is sharply cut, and the photographic element produced therefrom causes less dye stain after processing, must be provided.

SUMMARY OF THE INVENTION

A first object of the present invention is to obtain silver halide photographic emulsions which are spectrally sensitized in the blue range and have a spectral sensitization characteristic wherein the long wavelength of the spectral sensitization range thereof is sharply cut.

A second object of the present invention is to provide silver halide photographic emulsions spectrally sensitized by a combination of dyes which provides supersensitization and results in less dye stain on the processed photographic element.

A third object of the present invention is to provide high speed multilayer color photographic materials having good color reproduction, which have a blue-sensitive layer consisting of a photographic emulsion highly and spectrally sensitized in the blue range wherein the overlap with the spectral sensitivity of the green-sensitive layer is less.

Another object of the present invention is to provide silver halide photographic emulsions which are sensitized by a combination of dyes providing supersensitization wherein the spectral sensitivity does not decrease during preparation of the emulsion or during storage of the unprocessed photosensitive material even if anionic compounds (particularly, a gelatin coagulating agent) or color couplers are also present.

The above-described objects of the present invention are attained by incorporating a combination of at least one sensitizing dye represented by the formula (I)

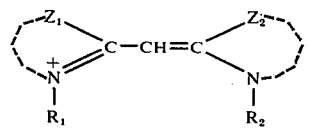

(I)

wherein $Z_1$ represents a group of atoms necessary to complete a thiazole nucleus, a benzothiazole nucleus, a benzoselenazole nucleus, a naphthothiazole nucleus or a naphthoselenazole nucleus; $Z_2$ represents a group of atoms necessary to complete a naphthothiazole nucleus or a naphthoselenazole nucleus; and $R_1$ and $R_2$, which may be the same or different, each represents an aliphatic group and at least one of $R_1$ and $R_2$ is an aliphatic group containing a carboxyl group or a sulfo group; and at least one sensitizing dye represented by the formula (II)

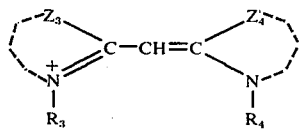

(II)

wherein $Z_3$ and $Z_4$ which may be the same or different, each represents a group of atoms necessary to complete a thiazole nucleus, a benzothiazole nucleus or a benzoselenazole nucleus; and $R_3$ and $R_4$, which may be the same or different, each represents an aliphatic group and at least one of $R_3$ and $R_4$ is an aliphatic group containing a carboxyl group or a sulfo group, in amounts sufficient to cause supersensitization in a silver halide photographic emulsion.

BRIEF DESCRIPTION OF THE DRAWING

The FIGURE shows the spectral transmittance curve of an SC-46 Filter produced by the Fuji Photo Film Co., Ltd. used in Examples 1 and 2.

DETAILED DESCRIPTION OF THE INVENTION

In the formula (I), $Z_1$ represents a group of atoms necessary to complete a thiazole nucleus, a benzothiazole nucleus, a benzoselenazole nucleus, a naphthothiazole nucleus or a naphthoselenazole nucleus. $Z_2$ represents a group of atoms necessary to complete a naphthothiazole nucleus or a naphthoselenazole nucleus. These nuclei for $Z_1$ and $Z_2$ can be substituted in positions other than the nitrogen atom, for example, with one or more of a halogen atom (for example, chlorine, bromine or fluorine), an alkyl group having 4 or less carbon atoms (for example, a methyl group, an ethyl group or a propyl group), an alkoxy group having 4 or less carbon atoms (for example, a methoxy group or an ethoxy group), a hydroxy group, a carboxyl group, an alkoxycarbonyl group having 4 or less carbon atoms (for example, an ethoxycarbonyl group), a substituted alkyl group (for example, a trifluoromethyl group, a benzyl group or a phenethyl group), a aryl group (for example, a phenyl group) and a substituted aryl group (for example, a p-tolyl group), etc.

Examples of heterocyclic nuclei completed by $Z_1$ or $Z_2$ include nuclei such as thiazole, 4-methyl thiazole, 4,5-dimethylthiazole, 4-phenylthiazole, 4-(p-tolyl)-thiazole, benzothiazole, 4-chlorobenzothiazole, 5-chlorobenzothiazole, 6-chlorobenzothiazole, 7-chlorobenzothiazole, 5-bromobenzothiazole, 6-bromobenzothiazole, 5-iodobenzothiazole, 5-fluorobenzothiazole, 4-methylbenzothiazole, 5-methylbenzothiazole, 6-methylbenzothiazole, 5,6-dimethylbenzothiazole, 5-methoxybenzothiazole, 6-methoxybenzothiazole, 5-ethoxybenzothiazole, 5-hydroxy-6-methylbenzothiazole, 5-carboxybenzothiazole, 5-ethoxycarbonylbenzothiazole, 5-trifluoromethylbenzothiazole, 5-phenylbenzothiazole, 4-phenylbenzothiazole, 5-phenethylbenzothiazole, benzoselenazole, 5-methylbenzoselenazole, 5-hydroxybenzoselenazole, 5-methoxybenzoselenazole, naphtho-(2,1-d)-thiazole, naphtho-(1,2-d)-thiazole, naphtho-(2,3-d)-thiazole, 5-methoxynaphtho-(1,2-d)-thiazole, 7-ethoxynaphtho-(2,1-d)-thiazole, 8-methoxynaphtho-(2,3-d)-thiazole, 8-chloronaphtho-(1,2-d)-thiazole, naphtho-(1,2-d)-selenazole, naphtho-(2,1-d)-selenazole and 8-chloronaphtho-(1,2-d)-selenazole, etc.

$R_1$ and $R_2$, which can be the same or different, each represents an aliphatic group having 8 or less carbon atoms (which can be a saturated or unsaturated aliphatic hydrocarbon group). The carbon chain of the aliphatic group can be interrupted by a hetero atom such as oxygen, sulfur or nitrogen, etc.). Suitable examples of aliphatic groups include alkyl groups and alkenyl groups (e.g., allyl). The aliphatic group may be substituted with one or more substituents such as a hydroxyl group, an alkoxy group (for example, a methoxy group or an ethoxy group), an alkylcarbonyloxy group (for example, such as an acetoxy group and a propionyloxy group), a phenyl group, a substituted phenyl group (for example, a sulfophenyl group and a chlorophenyl group), a carboxy group or a sulfo group. However, at least one of $R_1$ and $R_2$ must contain a carboxyl group or a sulfo group, and where both of $R_1$ and $R_2$ contain a carboxyl group or a sulfo group, one of $R_1$ or $R_2$ may form a salt with a cation such as an alkali metal atom (for example, a sodium atom or a potassium atom), an ammonium group, an organic base such as pyridine, trimethylamine, morpholine, etc. or an onium ion, etc.

Of the substituted and unsubstituted aliphatic groups with or without hetero atoms, examples of the groups which do not have a carboxyl group or a sulfo group include an alkyl group such as a methyl group, an ethyl group, a n-propyl group. etc., an alkenyl group such as a vinylmethyl group, etc., a hydroxyalkyl group such as a 2-hydroxyethyl group, a 4-hydroxybutyl group, etc., an acyloxyalkyl group such as an 2-acetoxyethyl group, a 3-acetoxypropyl group, etc., an alkoxyalkyl group such as a 2-methoxyethyl group and a 4-methoxybutyl group, etc. Examples of aliphatic groups which contain a carboxyl group or a sulfo group include a carboxyalkyl group such as a 2-carboxyethyl group, a 3-carboxypropyl group, a 2-(2-carboxyethoxy)ethyl group, etc., a sulfoalkyl group such as a 2-sulfoethyl group, a 3-sulfopropyl group, a 3-sulfobutyl group, a 4-sulfobutyl group, a 2-hydroxy-3-sulfopropyl group, a 2-(3-sulfopropoxy)ethyl group, a 2-acetoxy-3-sulfopropyl group, a 3-methoxy-2-(3-sulfopropoxy)propyl group, a 2-[2-(3-sulfopropoxy)ethoxy]ethyl group, a 2-hydroxy-3-(3'-sulfopropoxy)propyl group, etc., and the like. A p-carboxybenzyl group, a p-sulfobenzyl group or a p-sulfophenethyl group can also be employed as $R_1$ or $R_2$.

In the formula (II) above, $Z_3$ and $Z_4$, which can be the same or different, each represents a group of atoms necessry to complete a thiazole nucleus, a benzothiazole nucleus or a benzoselenazole nucleus. These nuclei can be substitiuted in addition to the substituents $R_3$ and $R_4$ on the nitrogen atoms.

Examples of suitable substituents include a halogen atom (for example, a chlorine atom, a bromine atom or a fluorine atom), an alkyl group having 4 or less carbon atoms (for example, a methyl group, an ethyl group or a propyl group), an alkoxy group having 4 or less carbon atoms (for example, a methoxy group or an ethoxy group), a hydroxy group, a carboxy group, an alkoxycarbonyl group having 4 or less carbon atoms (for example, an ethoxycarbonyl group), a substituted alkyl group (for example, a trifluoromethyl group, a benzyl group or a phenethyl group), an aryl group (for example, a phenyl group) and a substituted aryl group (for example, a p-tolyl group), etc. $R_3$ and $R_4$, which can be the same or different, each has the same meaning as in $R_1$ or $R_2$, and at least one of $R_3$ and $R_4$ represents an aliphatic group containing a carboxyl group or a sulfo group.

Examples of suitable heterocyclic nuclei completed by $Z_3$ or $Z_4$ include thiazole, 4-methylthiazole, 4,5-dimethylthiazole, 4-phenylthiazole, 4-(p-tolyl)thiazole, benzothiazole, 4-chlorobenzothiazole, 5-chlorobenzothiazole, 6-chlorobenzothiazole, 7-chlorobenzothiazole, 5-bromobenzothiazole, 6-bromobenzothiazole, 5-iodobenzothiazole, 5-fluorobenzothiazole, 4-methylbenzothiazole, 5-methylbenzothiazole, 6-methylbenzothiazole, 5,6-dimethylbenzothiazole, 5-methoxybenzothiazole, 6-methoxybenzothiazole, 5-ethoxy-benzothiazole 5-hydroxy-6-methylbenzothiazole, 5-carboxybenzothiazole, 5-ethoxycarbonylbenzothiazole, 5-trifluoromethylbenzothiazole, 5-phenylbenzothiazole, 4-phenylybenzothiazole, 5-phenethylbenzothiazole, benzoselenazole, 5-chlorobenzoselenazole, 5-methylbenzoselenazole, 5-hydroxybenzoselenazole and 5-methoxybenzoselenazole, etc.

Of the dyes represented by the formula (I) used in the present invention, particularly preferred dyes are represented by the following formula (III)

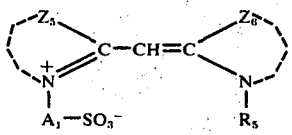

(III)

In the formula (III), $Z_5$ represents a group of atoms necesssary to complete a benzothiazole nucleus or a naphthothiazole nucleus and $Z_6$ represents a group of atoms necessary to complete a naphthothiazole nucleus. $A_1$ represents an alkylene group having 4 or less carbon atoms which can be substituted with a hydroxyl group (for example, an ethylene group, a 1,3-propylene group, a 1,4-butylene group or a 2-hydroxy-1,3-butylene group, etc.), $R_5$ represents an $—A_2—SO_3H$ group or an $—A_2—CO_2H$ group, wherein $A_2$ has the same meaning as $A_1$, and $A_2$ and $A_1$ can be the same or different.

Above all, particularly preferred sensitizing dyes of the formula (III) are those represented by the formula (IV).

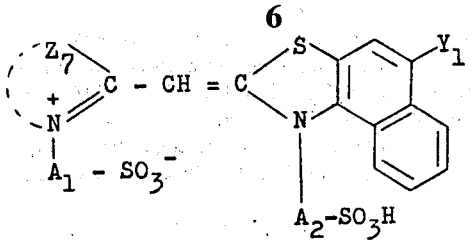

(IV)

In the formula (IV), $Z_7$ represents a group of atoms necessary to complete a benzothiazole nucleus or a naphtho(1,2-d)-thiazole nucleus. $A_1$ and $A_2$ each have the same meaning as described above. $Y_1$ represents a hydrogen atom or a halogen atom (for example, a chlorine atom or a bromine atom).

Of the dyes represented by the formula (II) used in the present invention, particularly preferred dyes are represented by the following formula (V),

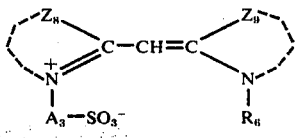

(V)

In the formula, $Z_8$ and $Z_9$, which may be the same or different, each represents a group of atoms necessary to complete a benzothiazole nucleus or a benzoselenazole nucleus. $A_3$ represents an alkylene group having 4 or less carbon atoms which can be substituted with a hydroxyl group (for example, an ethylene group, a 1,3-propylene group, a 1,4-butylene group or a 2-hydroxy-1,3-propylene group, etc.). $R_6$ represents an $—A_4—SO_3H$ group or an $—A_4—CO_2H$ group, wherein $A_4$ has the same meaning as $A_3$, and $A_4$ and $A_3$ can be the same or different.

Of the dyes represented by the formula (V), particularly preferred dyes are those represented by the following formula (VI)

(VI)

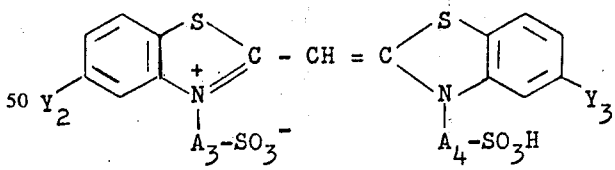

In the formula, $Y_2$ and $Y_3$, which may be the same or different, each represents an alkyl group having 4 or less carbon atoms (for example, a methyl group or an ethyl group), an alkoxy group having 4 or less carbon atoms (for example, a methoxy group or an ethoxy group), a halogen atom (for example, a chlorine atom or a bromine atom), an aryl group (for example, a phenyl group) or a hydrogen atom. However, $Y_2$ and $Y_3$ are not both simultaneously a hydrogen atom. $A_3$ and $A_4$ each have the same meaning as described in the formula (IV).

The dyes represented by the formulae (I) and (II) are known and can be easily produced by persons skilled in the art by reference to U.S. Pat. Nos. 3,149,105 and 2,238,231, British Patent 742,112 or F. M. Hamer, *The Cyanine Dyes and Related Compounds*, pages 55 et seq., Interscience Publishers, New York (1964) or by similar processes.

Typical examples of the sensitizing dyes represented by the formula (I) which can be used in the present invention are described in the following. However, the sensitizing dyes used in the present invention are not limited to these dyes.

Dye I - 1

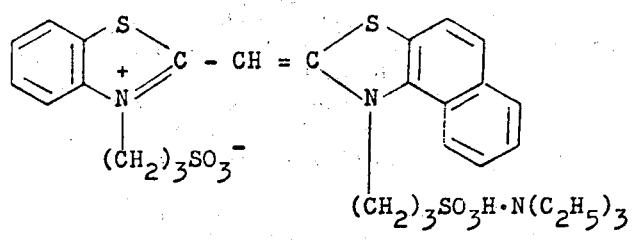

Dye I - 2

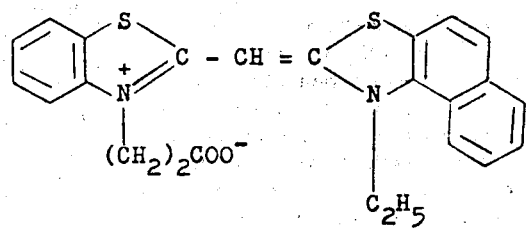

Dye I - 3

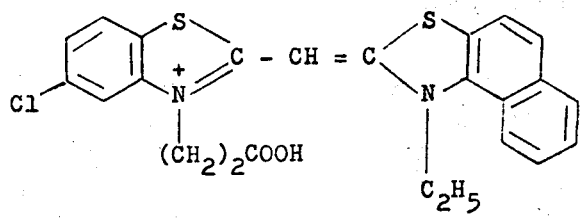

Dye I - 4

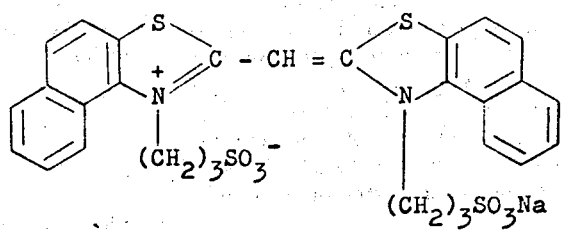

Dye I - 5
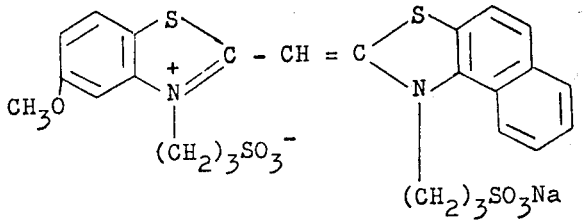
Dye I - 6
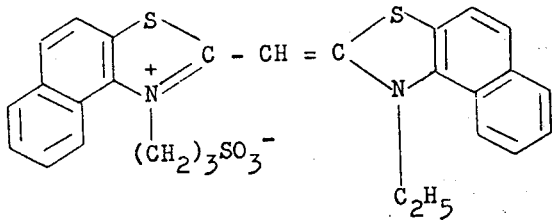
Dye I - 7
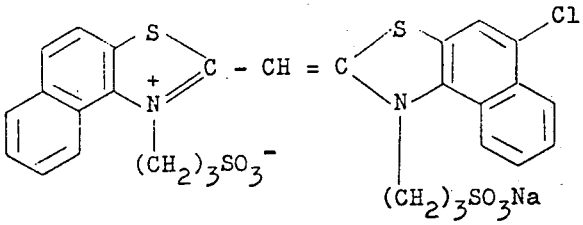
Dye I - 8
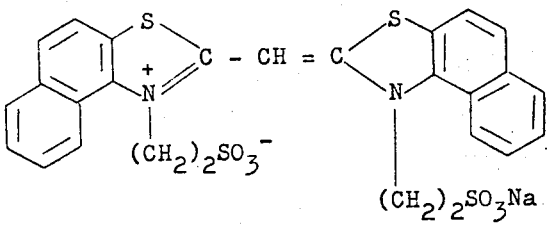
Dye I - 9
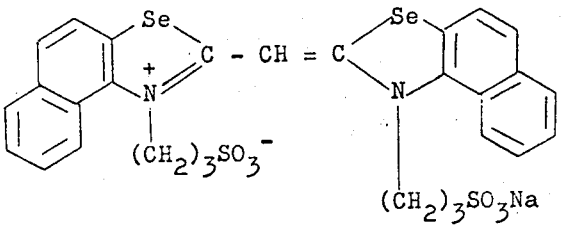

Dye I - 10
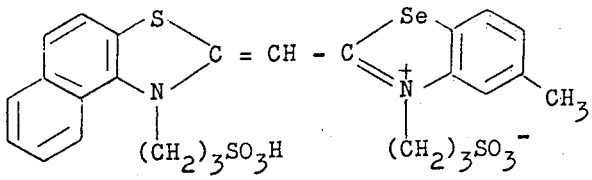
Typical examples of sensitizing dyes represented by the formula (II) which can be used in the present invention are described in the following. However, the sensitizing dyes used in the present invention are not limited to these dyes.
Dye II - 1
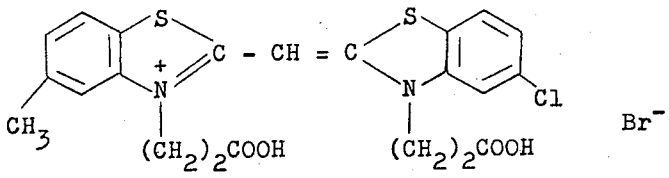
Dye II - 2
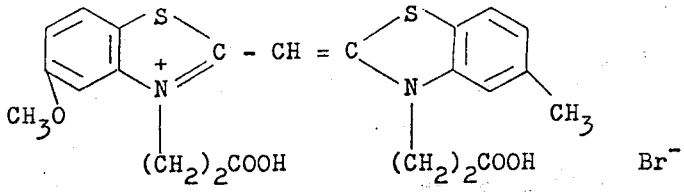
Dye II - 3
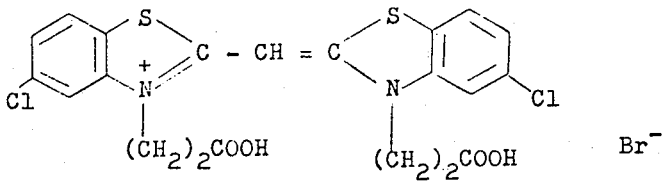
Dye II - 4
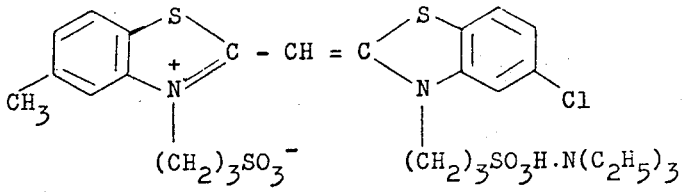

Dye II - 5
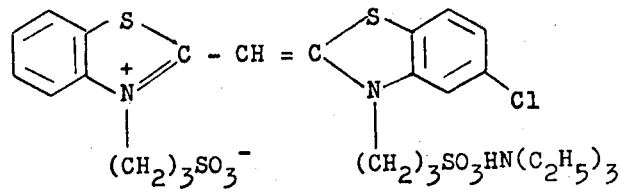
Dye II - 6
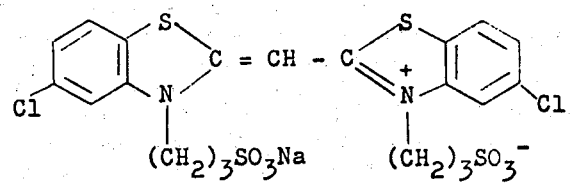
Dye II - 7
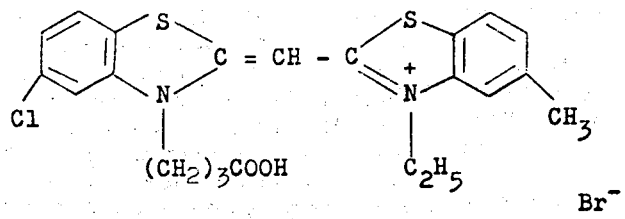
Dye II - 8
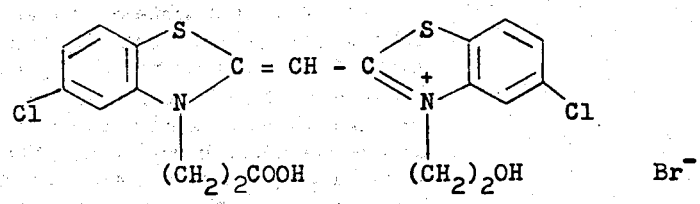
Dye II - 9
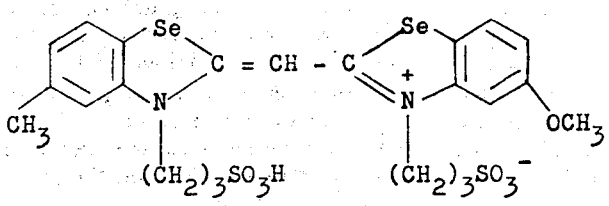

Dye II - 10

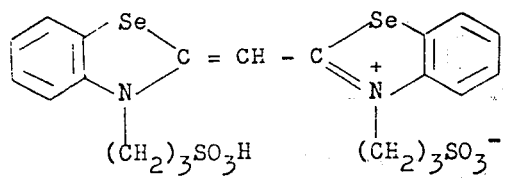

The optimum concentration of the sensitizing dyes used in the present invention can be determined according to a method well known by persons skilled in the art which comprises dividing an emulsion into several portions, incorporating sensitizing dyes in each portion in a different concentrations, and determining the sensitivity of each.

Although the amount of the sensitizing dyes for supersensitization in the present invention is not restricted, the sensitizing dyes are preferably used in an amount of about $2 \times 10^{-6}$ to about $1 \times 10^{-3}$ mols per mol of silver halide. Particularly, an amount of $5 \times 10^{-6}$ to $1 \times 10^{-4}$ mols is preferred. The ratio of the preferred amounts of the dye represented by the formula (I) and the dye represented by the formula (II) for providing supersensitization is about 20:1 to 1:20 and preferably is 5:1 to 1:5.

The photographic emulsions according to the present invention can contain other sensitizing dyes in addition to the dyes represented by the formulae (I) and (II) or known substantially colorless compounds providing supersensitization in an amount which does not adversely influence the effect of the present invention. For example, the photographic emulsions can contain compounds having a pyrimidinylamino group or a triazinylamino group as described in U.S. Pat. Nos. 2,933,390, 3,511,664, 3,615,613, 3,615,632 and 3,615,641, aromatic organic acid-formaldehyde condensation products as described in British Pat. No. 1,137,580, azaindenes or cadmium salts, etc.

The photosensitive materials using the photographic emulsions of the present invention can contain other emulsion layers which are spectrally sensitized and/or other emulsion layers which are not spectrally sensitized at the same time, and positions of these layers in the photosensitive material can be selected as described.

The addition of the sensitizing dyes to the emulsions can be carried out by methods well known in the photograhic art.

The sensitizing dyes can be dispersed directly in the emulsion or can be added to the emulsion as a solution by dissolving the dyes in a water-soluble solvent such as pyridine, methyl alcohol, ethyl alcohol, methyl Cellosolve or acetone (or mixtures of thereof), and, if necessary, diluting the solution with water or dissolving the dyes in water. Further, ultrasonic vibration for dissolution of the dyes can be used. Furthermore, a process which comprises dissolving the dyes in a volatile organic solvent, dispersing the resulting solution in a hydrophilic colloid and adding the resulting dispersion to the emulsion, as described in U.S. Pat. No. 3,469,987 or a process which comprises dispersing water-insoluble dyes in a water-soluble solvent without dissolving the dyes and adding the resulting dispersion to the emulsion, as described in Japanese Pat. No. 24185/1971 can be used. Further, the dyes can be added to the emulsion as a dispersion by dissolving the dye in an acid solution and dispersing the solution in the emulsion. In addition, addition of the dyes to the emulsion can be carried out by the processes described in U.S. Pat. Nos. 2,912,345, 3,342,605, 2,996,287 and 3,425,835.

Although utilization of a process which comprises dissolving the sensitizing dyes to be incorporated as the combination of the present invention in the same solvents or in different solvents and mixing the resulting solutions prior to addition to the silver halide emulsion is preferred, if desired, a process which comprises dissolving each dye in a suitable solvent and adding the resulting solutions to the emulsion, respectively, can be used. Although these dyes can be added to the emulsion at any step in the preparation of the emulsion, it is convenient to add the dyes after conclusion of the second ripening prior to coating of the emulsion.

Suitable silver halides which can be used for the emulsions of the present invention, include silver chloride, silver bromide, silver iodide, silver bromochloride, silver iodobromide and silver iodobromochloride. Particularly, silver bromochloride and silver iodobromochloride (particularly, containing less than about 1 mol% silver iodide) can be advantageously used.

Although gelatin is usually used as a vehicle in the silver halide emulsions of the present invention, materials which do not adversely influence the photosensitive silver halide, such as albumin, agar, gum arabic or alginic acid, hydrophilic resins such as polyvinyl alcohol or polyvinyl pyrrolidone, or cellulose derivatives can be used instead of gelatin.

These emulsions can contain either fine grains or coarse grains or can contain a mixture of these grains. These silver halide grains can be formed by known processes, for example, a single jet process, a double jet process or a control double jet process.

Further, the silver halide grains can have a homogeneous crystal structure or can have a heterogeneous layer structure wherein the interior and the outer portion are different. Further, the grains can have a so-called conversion type structure as described in U.S. Pat. No. 3,622,318 and British Pat. No. 635,841. Further, the grains can have a structure wherein latent images are mainly formed on the surface of the grains or can have an internal latent image type structure wherein latent images are mainly formed in the interior of the grains. These photographic emulsions are described in C.E.K. Mees & T.H. James, *The Theory of Photographic Process*, 3rd Ed., MacMillan Co., New York (1966) or P. Glafkides, *Photographic Chemistry*, Fountain Press Co., and can be prepared by various known processes such as an ammonia process, a neutralization process or an acid process, etc.

Although the average particle size of the silver halide grains used (for example, a number average determined by a projected area method) is not limited, a range of about 0.04 $\mu$ to about 2 $\mu$ is preferred. The distribution of the grain size (where the grain size has the above-described meaning) can be either narrow or broad.

The silver halide emulsions can be physically ripened or unripened. Usually, water-soluble salts are removed from the emulsion after formation of the silver halide precipitates or after physical ripening. A noodle water washing method which is well known, and a flocculation method wherein an inorganic salt containing a polyvalent anion (for example, ammonium sulfate), anionic surface active agents, polystyrene sulfonic acid and other anionic polymers or gelatin derivatives such as aliphatic or aromatic acylated gelatin can be utilized.

The silver halide emulsions can be either chemically sensitized or chemically unsensitized (a so-called nonripened emulsion). Typical methods for chemical sensitization include, the methods described in Mees and James, supra, Glafkides, supra, or H. Frieser, Ed., *Die Grundlagen der Photographischen Prozesse mit Silberhalogeniden*, akademische Verlagsgellschaft (1968), and other various known methods can be used. Suitable methods include a sulfur sensitization method which comprises using sulfur containing compounds capable of reacting with silver ions to form silver sulfide such as thiosulfates or the compounds described in U.S. Pat. Nos. 1,574,944, 2,278,947, 2,410,689, 3,189,458 and 3,501,313 and French Pat. No. 2,059,245; or activated gelatin, etc.; a reduction sensitization method which comprises using reducing agents, for example, stannous salts described in U.S. Pat. No. 2,487,850 amines described in U.S. Pat. Nos. 2,518,698, 2,521,925, 2,521,926, 2,419,973 and 2,419,975, imino-aminomethane sulfinic acids described in U.S. Pat No. 2,983,610 or silane compounds described in U.S. Pat. No. 2,694,637, or utilizing the method described in H. W. Wood, *Journal of Photographic Science*, Vol. 1 (1953) pages 163 et seq.; a gold sensitization method which comprises using gold complex salts described in U.S. Patent 2,399, 083 or gold thiosulfate complex salts, etc.; and a sensitization method which comprises using salts of noble metals such as platinum, palladium, iridium, rhodium or ruthenium described in U.S. Pat. Nos. 2,448,060, 2,540,086, 2,566,245 and 2,566,263. These methods can be utilized individually or as a combination thereof. Further, the selenium sensitization method described in U.S. Pat. No. 3,297,446 can be used instead of or together with the sulfur sensitization method.

The photographic emulsions of the present invention can contain various compounds for the purpose of preventing the generation of fog during production, during storage of a photosensitive material or during development or for the purpose of stabilizing the photographic properties of the photosensitive material. For example, azoles, for example, benzotriazoles, benzothiazolium salts described in U.S. Pat. No. 2,131,038 and aminobenzimidazoles described in U.S. Pat. No. 2,324,123; nitroazoles, nitrobenzotriazoles, nitrobenzimidazoles described in British Pat. No. 403,789 and nitroaminobenzimidazoles described in U.S. Pat. No. 2,324,123; halogen substituted azoles, for example, 5-chlorobenzimidazole, 5-bromoimidazole and 6-chlorobenzimidazole, etc.; mercaptoazoles, for example, mercaptothiazole derivatives described in U.S. Pat. No. 2,824,001, mercaptobenzothiazole, mercaptobenzothiazole derivatives described in U.S. Pat. No. 2,697,099, mercaptoimidazole derivatives described in U.S. Pat. No. 3,252,799, mercaptobenzimidazoles, mercaptooxadiazoles described in U.S. Pat. No. 2,843,491, mercaptothiadizoles described in U.S. Pat. No. 1,758,576 and phenylmercaptotetrazoles described in U.S. Pat. No. 2,304,962, etc.; mercaptotriazines described in U.S. Pat. No. 2,476,536; mercaptotetrazaindenes described in British Pat. No. 3,226,231; mercapto compounds such as thiosalicylic acid described in U.S. Pat. No. 2,377,375, thiobenzoic acid described in British Pat. No. 3,226,231, sugar mercaptals described in Japanese Pat. No. 8743/1972 and other various mercapto compounds; oxazolinethiones described in U.S. Pat. No. 3,251,691 and triazolothiadiazoles described in Japanese Patent Publication 17932/1968 can be employed. Further, nitrogen-containing heterocyclic compounds having an antifogging function such as azaindene compounds, for example, tetrazaindenes or compounds described in U.S. Pat. Nos. 2,444,605, 2,444,606 and 2,450,397 and Japanese Pat. Nos. 10166/1964 and 10516/1967; pentazaindenes, for example, compounds described in U.S. Pat. No. 2,713,541 and Japanese Pat. No. 13495/1968; or urazoles described in U.S. Pat No. 2,708,161 can be added. Furthermore, the benzenesulfinic acids described in U.S. Pat. No. 2,394,198, benzenethiosulfonic acids, benzenesulfinic acid amides described in Japanese Pat. No. 4136/1968 or sugar mercaptal described in Japanese Pat. No. 8743/1972 can be incorporated in the emulsion. Further, it is possible to add various chelating agents described in U.S. Pat. No. 2,691,588, British Pat. No. 624,488 and Japanese Pat. Nos. 4941/1968 and 13496/1968 for preventing generation of fog caused by metal ions.

For the purpose of increasing the sensitivity, improving the contrast or accelerating the development, the photographic emulsions of the present invention can contain the polyalkylene oxides described in U.S. Pat. No. 2,441,389, the ethers, esters and amides of polyalkylene oxides described in U.S. Pat. No. 2,708,161, and other polyalkylene oxide derivatives described in British Pat. No. 1,145,186 and Japanese Pat. No. 10989/1970, 15188/1970, 43535/1971, 8106/1972 and 8742/1972; thioether compounds described in U.S. Pat. Nos. 3,046,132 – 3,046,135 and Japanese Pat. No. 9019/1970 and 11119/1972, thiomorpholines described in Japanese Pat. No. 28325/1972; quaternary ammonium compounds described in U.S. Pat. No. 3,772,021; pyrrolidines described in Japanese Patent Publication 27037/1970; urethane or urea derivatives described in Japanese Pat. No. 23465/1965; imidazole derivatives described in Japanese Pat. No. 45541/1972; polymers described in Japanese Pat. No. 26471/1970; and 3-pyrazolidones described in Japanese Pat. No. Publication 27670/1970.

Inorganic or organic mercury compounds can be added to the photographic emulsions of the present invention for the purpose of sensitization or antifogging. For example, complex salts described in U.S. Pat. No. 2,724,664; mercury benzothiazole described in U.S. Pat. No. 2,728,667; mercury salt addition compounds described in U.S. Pat. Nos. 2,728,663 and 2,732,302; and organic mercury compounds described in U.S. Pat. Nos. 2,728,665 and 3,420,668 can be used.

The photographic emulsions of the present invention can contain additives having various functions for improving the quality of the photosensitive material, such as hardening agents, coating assistants, plasticizers, emulsion polymerized latexes or antioxidants, etc. These additives are described in detail in the following.

The photographic emulsions of the present invention can be hardened by adding conventionally used hardening agents. Examples of suitable hardening agents include, for example, aldehydes, for example, glyoxal described in U.S. Pat. No. 1,870,354 and glutaraldehyde described in British Pat. No. 825,544; N-methylol compound, for example, N,N'-dimethylol urea and dimethylol hydantoin described in British Pat. No. 676,628, etc.; dioxane derivatives, for example, dihydroxydioxane described in U.S. Pat. No. 3,380,829 and dioxane derivatives described in Japanese Pat. No. 38713/1971; epoxy group containing compounds, for example, compounds described in U.S. Pat. Nos. 3,047,394 and 3,091,537 and Japanese Pat. No. 7133/1959; reactive halogen containing compounds, for example, 2,4-dichloro-6-hydroxy-1,3,5-triazine described in U.S. Pat. No. 3,325,287; mucohalic acids, for example, mucochloric acid described in U.S. Pat. No. 2,080,019, mucobromic acid and derivatives of mucohalic acids described in Japanese Pat. No. 1872/1971; bis-(methane sulfonic acid ester) described in U.S. Pat. No. 2,726,162; sulfonyl compounds, for example, bis-(benzenesulfonyl chloride) described in U.S. Pat. No. 2,725,295; aziridine compounds, for example, compounds described in Japanese Pat. Nos. 4212/1958 and 8790/1962; divinyl sulfones, for example, compounds described in U.S. Pat. No. 2,579,871; reactive olefin containing compounds, for example, divinyl ketones such as compounds described in German Pat. No. 872,153 and acryloyl group containing compounds described in U.S. Pat. Nos. 3,255,000 and 3,635,718, British Pat. No. 994,869 and German Pat. No. 1,090,427; alkylene bismaleimides described in U.S. Pat. No. 2,992,109, isocyanates described in U.S. Pat. No. 3,103,437, carbodiimides described in U.S. Pat. No. 3,100,704, isoxazole derivatives, and the compounds described in U.S. Pat. Nos. 3,321,313 and 3,543,292; carbamoyl chloride derivatives described in Japanese Pat. No. 6899/1966; high molecular weight hardening agents, for example, dialdehyde starch described in U.S. Pat. No. 3,057,723, and compounds described in Japanese Pat. No. 12550/1967; and inorganic hardening agents, for example, chromium alum, chromium acetate and zirconium sulfate, etc. These hardening agents can be used individually or as a combination of two or more thereof.

Various known surface active agents can be added to the photographic emulsions of the present invention as coating assistants or for the purpose of inhibiting the generation of electrostatic charges or improving the lubrication properties. For example, nonionic surface active agents such as saponin, polyethylene glycol, polyethylene glycol-polypropylene glycol condensation products described in U.S. Pat. No. 3,294,540, and polyalkylene glycol ethers, esters and amides described in U.S. Pat. Nos. 2,240,472 and 2,831,766; anion surface active agents such as, for example, alkylcarboxylates, alkyl sulfonates, alkylbenzene sulfonates, alkylnaphthalene sulfonates, alkyl sulfate esters, N-acylated-N-alkyltaurines described in U.S. Pat. No. 2,739,891, maleopimelates described in U.S. Pat. Nos. 2,359,980, 2,409,930 and 2,447,750, and compounds described in U.S. Pat. Nos. 2,823,123 and 3,415,649; and ampholytic surface active agents such as compounds described in British Pat. No. 1,159,825, Japanese Pat. No. 378/1965, Japanese patent application (OPI) 43924/1973 and U.S. Pat. No. 3,726,683, etc. can be used.

The photographic emulsions of the present invention can contain plasticizers such as glycerin, diols described in U.S. Pat. No. 2,960,404 and trihydric aliphatic alcohols described in U.S. Pat. No. 3,520,694.

The photographic emulsions of the present invention can contain dispersions of water-insoluble or difficultly water-soluble synthetic polymers for the purpose of improving the dimensional stability. For example, it is possible to use homo- or copolymers of alkyl acrylates or methacrylates, alkoxy acrylates or methacrylates, glycidyl acrylates or methacrylates, acryl or methacrylamide, vinyl acetate, acrylonitrile, olefins and styrene, and copolymers of the above described monomers and acrylic acid, $\alpha,\beta$-unsaturated dicarboxylic acids, sulfoalkyl acrylates or styrenesulfonic acids, etc. Examples of suitable polymers include those described in U.S. Pat. Nos. 2,376,005, 3,607,290, 3,645,740, 3,062,674, 2,739,137, 3,411,911, 3,488,708, 3,635,715 and 2,853,457 and British Pat. No. 1,186,699 and 1,307,373.

Further, the dyes described in, for example, Japanese Pat. Nos. 20389/1966, 3504/1968 and 13168/1968, U.S. Pat. Nos. 2,697,037, 3,423,207 and 2,865,752 and British Pat. Nos. 1,030,392 and 1,100,546 can be used as antiirradiation dyes.

The photographic emulsions of the present invention can contain conventionally used non-diffusible color-forming couplers. A color-forming coupler is a compound which forms a dye by reacting with the oxidation products of aromatic primary amine developing agents at development (hereinafter called a coupler). The couplers can be either 4-equivalent or 2-equivalent couplers or can be colored couplers used for color correction. Further, suitable couplers are those which release a development inhibitor. Open-chain ketomethylene type compounds such as acylaminoacetamide type compounds are preferably used as yellow dye-forming couplers. Pyrazolone-type or cyanoacetyl-type compounds are suitably used as magenta dye-forming couplers. Naphthol-type or phenol-type compounds are suitably used as cyan dye-forming couplers. The couplers can be added to the photographic emulsion layers utilizing conventional methods used for multicolor photographic materials.

Examples of such couplers, include the 4-equivalent type or 2-equivalent type diketomethylene yellow couplers, for example, compounds described in U.S. Pat. Nos. 3,277,157, 3,415,652, 3,447,928, 3,311,476 and 3,408,194, compounds described in U.S. Pat. Nos. 2,875,057, 3,265,506, 3,409,439, 3,551,155 and 3,551,156 and Germany patent application (OLS) 1,956,281 and 2,162,899, and compounds described in Japanese Pat. Nos. 26133/1972 and 66836/1973; 4-equivalent type or 2-equivalent type pyrazolone magenta couplers or imidazolone magenta couplers, for example, compounds described in U.S. Pat. No. 2,600,788, 2,983,608, 3,006,759, 3,062,653, 3,214,437, 3,253,924, 3,419,391, 3,419,808, 3,476,560 and 3,582,322, Japanese Pat. No. 20636/1970and Japanese Pat. application (OPI) 26133/1972; and α-naphthol cyan couplers and phenol type cyan couplers, for example, compounds described in U.S. Pat. Nos. 2,474,293, 2,698.794, 3,034,892, 3,214,437, 3,253,924, 3,311,476, 3,458,315 and 3,591,383 and Japanese Pat. Nos. 11304/1967 and 32461/1969. In addition, the DIR couplers or DIR compounds described in U.S. Pat. Nos. 3,,227,554, 3,148,062, 3,297,445, 3,253,924, 3,311,476, 3,379,529, 3,516,831, 3,617,291, 3,705,801 and 3,632,345 and German patent application (OLS) 2,163,811 can be used. These couplers can be dispersed using the method described in U.S. Pat. No. 2,801,171.

The present invention can be applied to multilayer multicolor photographic materials which have at least two layers, each with a different spectral sensitivity, on a support. The multilayer color photographic materials generally comprise at least one red-sensitive silver halide emulsion layer, at least one green-sensitive silver halide emulsion layer and at least one blue-sensitive silver halide emulsion layer on a support. The order of these layers can be suitably varied. A combination in which a cyan forming coupler is included in the red-sensitive silver halide emulsion layer, a magenta forming coupler is included in the green-sensitive silver halide emulsion layer and a yellow forming coupler is included in the blue-sensitive silver halide emulsion layer is usually used. However, if desired, other combinations can be used as well.

The photographic emulsions of the present invention can contain developing agents, for example, aromatic diols such as hydroquinones, aminophenols, phenylenediamines, 3-pyrazolidones, ascorbic acid or derivatives thereof, which can used individually or as a combination of two or more thereof. A combination of hydroquinone and the N-hydroxyalkyl substituted p-aminophenol derivatives, described in Japanese Pat. No. 43814/1973, is particularly preferred. The developing agents can be added as a dispersion when they are water-insoluble. For example, the developing agents can be added as a dispersion as described in U.S. Pat. No. 2,592,368 or French Pat. No. 1,505,778.

The photographic emulsions of the present invention can be coated separately or together with other hydrophilic colloid layers on supports using various known coating methods. Examples of suitable coating methods include a dip coating method, an air-knife coating method, a curtain coating method and an extrusion coating method. The method described in U.S. Pat. No. 2,681,294 is an advantageous coating. Further, two or more layers can be coated at the same time utilizing the method described in U.S. Pat. No. 2,761,791, or 3,526,528.

Suitable supports, include any transparent and opaque supports conventionally used for photographic elements. For example, glass plates; films of synthetic high molecular weight materials such as polyalkyl acrylates or methacrylates, polystyrene, polyvinyl chloride, partially formalated polyvinyl alcohol, polycarbonates, polyesters such as polyethylene terephthalate and polyamides; films of cellulose derivatives such as cellulose nitrate, cellulose acetate or cellulose acetate butyrate; paper, baryta-coated paper, α-olefin polymer coated paper, synthetic paper composed of polystyrene, ceramics and metals, etc. can be used as supports.

The photographic processings of the photographic emulsions of the present invention can be carried out using known methods. Suitable processing solutions include known processing solutions and suitable processing temperatures are temperatures lower than about 18°C, about 18°C to about 50°C and above about 50°C.

The photosensitive materials of the present invention can be processed by a development in which silver images are formed (black-and-white photographic processing) or can be processed by a color photographic development in which dye images are formed.

Suitable developing agents include 4-aminophenols such as N-methyl-4-aminophenol hemisulfate (Metol), N-benzyl-4-aminophenol hydrochloride, N,N-diethyl-4-aminophenol hydrochloride and 4-aminophenol sulfate; 3-pyrazolidones such as 1-phenyl-3-pyrazolidone, 4,4-dimethyl-1-phenyl-3-pyrazolidone or 4-methyl-1-phenyl-3-pyrazolidone; polyhydroxybenzenes such as hydroquinone, 2-methylhydroquinone, 2-phenylhydroquinone, 2-chlorohydroquinone, pyrogallol or catechol; p-phenylenediamines such as p-phenylenediamine hydrochloride or N,N-diethyl-p-phenylenediamine sulfate, ascoribic acid, N-(p-hydroxyphenyl)glycine as well as the developing agents described in C.E.K. Mees and T.H. James, supra, Chapter 13, and L.E.A. Mason, *Photographic Processing Chemistry*, pages 16–30, Focal Press (1966). These developing agents can be used individually or as a combination of two or more thereof.

In the present invention, dye images can be formed by a color development processing of the silver halide photographic emulsions. Color development processing essentially includes a color development step, a bleaching step and a fixing step.

In such processing, two or more steps can be sometimes carried out simultaneously as one step using a processing solution capable of performing both functions (for example, a one-bath bleaching-fixing solution). The processing temperature is set in a suitable range depending on the composition of the photosensitive material, and the temperature employed can be sometimes below about 18°C but often is above about 18°C. Particularly, a range of about 20°C to 60°C is often used. Recently, a range of about 30°C to 60°C is suitably used.

A color developer is an aqueous alkaline solution having a pH of about 8 and preferably 9 to 12 containing a compound, a developing agent, which produces color products on reacting with couplers.

The above-described developing agent is a compound which has a primary amino group on an aromatic ring and has the ability of developing light-exposed silver halide, or a precursor thereof which forms such compound. Typical examples of suitable developing agents include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfonamidoethyl-N,N-diethylaniline and the salts of these compounds (for example, the sulfates, hydrochlorides, sulfites and p-toluenesulfonates, etc.). In addition, the compounds described in U.S. Pat. Nos. 2,193,015 and 2,592,364, Japanese patent application (OPI) 64933/1973, and L.F.A. Mason, *Photographic Processing chemistry*, pages 226–229, Focal Press, London (1966) can be used. The above-described compounds can be used together with 3-pyrazolidones.

Various additives can also be added to the color developer, if desired. For example, development accelerating agents, for example, pyridinium compounds and cationic compounds described in U.S. Pat. Nos. 2,648,604 and 3,671,247, potassium nitrate or sodium nitrate, polyethyleneglycol condensation products or derivatives thereof described in U.S. Pat. Nos. 2,533,990, 2,577,127 and 2,950,970, nonionic compounds such as polythioethers described in British Pat. Nos. 1,020,033 and 1,020,032, polymer compounds containing a sulfite ester group described in U.S. Pat. No. 3,068,097, organic amines such as pyridine or ethanolamine, benzyl alcohol or hydrazines, etc.; antifogging agents, for example, alkali metal bromides, alkali metal iodides, nitrobenzimidazoles described in U.S. Pat. Nos. 2,496,940 and 2,656,271, mercaptobenzimidazole, 5-methylbenzotriazole, 1-phenyl-5-mercaptotetrazole, compounds described in U.S. Pat. Nos. 3,113,864, 3,342,596, 3,295,976, 3,615,522 and 3,597,199, thiosulfonyl compounds described in British Pat. No. 972,211, phenazine-N-oxides described in Japanese Pat. No. 41675/1971, or antifogging agents described in *Kagaku Shashin Binran* (*Manual of Photographic Science*), Vol. 2, pages 29047; anti-stain or sludge preventing agents described in U.S. Pat. Nos. 3,161,513 and 3,161,514 and British Pat. Nos. 1,030,443, 1.144,481 and 1,251,558, or interlayer effect accelerating agents described in U.S. Pat. No. 3,536,487 can be added to the color developer.

Although the photosensitive materials composed of the photographic emulsions of the present invention can be fixed according to known processes after development, they sometimes are subjected to bleaching. The bleaching can be carried out separately or simultaneously with the fixing. Where the bleaching is carried out simultaneously with the fixing, a bleaching agent and a fixing agent are employed together to make a bleach-fixing, or blixing, bath. Many compounds can be used as the bleaching agent. Examples of bleaching agents include ferricyanides, dichromates, water soluble cobalt (III) salts, water soluble copper (II) salts, water soluble quinones, nitrosophenols, polyvalent metal compounds such as of iron (III), cobalt (III) or copper (II), complex salts of these polyvalent metal cations and organic acids, for example, metal complex salts of aminopolycarboxylic acids such as ethylenediamine tetraacetic acid, nitrilotriacetic acid, iminodiacetic acid or N-hydroxyethylethylenediamine triacetic acid, etc., malonic acid, tartaric acid, malic acid, diglycolic acid or dithioglycolic acid, etc., peracids such as alkyl peracids, persulfates, permanganates or hydrogen peroxide, and hypohalites, for example, hypochlorite, hypocromite. These bleaching agents can be used individually or as a suitable combination thereof. The bleaching, the fixing and the bleach-fixing have been described in U.S. Pat. No. 3,582,322.

Bleach accelerating agents described in U.S. Pat. Nos. 3,042,520 and 3,241,966 and Japanese Pat. Nos. 8506/1970 and 8836/1970 can also be added to the above processing solutions.

The present invention can be applied to various color- or black-white photosensitive silver halide emulsions. Examples of such emulsions include emulsions for color positives, emulsions for color papers, emulsions for color negatives, emulsions for color reversal materials (which may contain couplers), emulsions for lithographic photosensitive materials (for example, lithofilms), emulsions used for photosensitive materials for recording a cathode ray tube display, emulsions used for photosensitive materials for recording X-rays (particularly, materials for photographing directly or indirectly using an intensifying screen), emulsions used for colloid-transfer processes (as described in, for example, U.S. Pat. No. 2,716,059), emulsions used for silver salt diffusion transfer processes (as described in, for example, U.S. Pat. Nos. 2,352,014, 2,543,181, 3,020,155 and 2,861,885), emulsions used for color diffusion transfer processes (as described in, for example, U.S. Pat. Nos. 3,087,817, 3,185,567, 2,983,606, 3,253,915, 3,227,550, 3,227,551, 3,227,552, 3,415,644, 3,415,645 and 3,415,646), emulsions used for dye transfer processes (as described in, for example, U.S. Pat. No. 2,882,156), emulsions used for silver dye bleaching processes (as described in Friedman, *History of Color Photography*, Chapter 24, American Photographic Publishers Co., (1944), *British Journal of Photography*, Vol. III, pages 308–309, (Apr. 7, 1964), emulsions used for materials for recording print-out images as described in, for example, U.S. Pat. No. 2,369,449) and Belgian Pat. No. 704,255), emulsions used for light-developable type print-out photosensitive materials (as described in, for example, U.S. Pat. Nos. 3,033,682 and 3,287,137), emulsions used for heat-developable photosensitive materials (as described in, for example, U.S. Pat. Nos. 3,152,904, 3,312,550 and 3,148,122, and British Pat. 1,110,046), and emulsions used for physically developable photosensitive materials (as described in, for example, British Pat. Nos. 920,277, and 1,131,238).

A characteristic of the present invention is the fact that supersensitization occurs when a combination of the sensitizing dye represented by the formula (I) and the sensitizing dye represented by the formula (II) is used. It is difficult to predict that supersensitization will occur with a combination of sensitizing dyes from only their chemical structure. Even a slight difference in the chemical structure has marked influence upon supersensitization.

Both of the dyes represented by the formula (I) and the dye represented by the formula (II) are monomethine cyanine dyes. A feature of the chemical structure of the dyes represented by the formula (I) is that one basic nucleus is a naphthothiazole nucleus or a naphthoselenazole nucleus. On the other hand, a feature of the chemical structure of the dyes represented by the formula (II) is that the basic nucleus is a triazole nucleus, a benzothiazole nucleus or a benzoselenazole nucleus. It is a surprising that supersensitization appears with the combination of monomethine cyanine dyes each of which has a different chemical structure from the other.

Another characteristic of the present invention is that high blue sensitivity is obtained by using the combination of the above described supersensitizing dyes, while the long wavelength range of the spectral sensitivity distribution is sharply cut. Accordingly, where the photographic emulsion of the present invention is used for a blue-sensitive layer of a color photographic element, it becomes possible to obtain excellent color reproduction because of the good color separation from the green-sensitive layer. On the other hand, in sensitizing the blue range of a black-and-white photographic element, it becomes possible to handle such an element under a safe light which is comparatively bright visually.

Another characterisic of the present invention is that silver halide photographic emulsions which have a high blue sensitivity as well as a low dye-stain caused by the dyes can be obtained.

Although the dyes represented by the formula (III) and the dyes represented by the formula (V) both have a sulfo group containing alkyl group as an N-substituent on the basic nucleus, a considerable dye stain occurs when each of them is used individually. Accordingly, it is unexpected that dye stain is remarkably decreased if both of these dyes are used together.

Further, the supersentizing combination of the present invention provides high blue-sensitivity even though the combination is used together with anionic compounds which are thought to impede the spectral sensitization (for example, antiirradiation dyes containing a sulfo group in their chemical structure, or gelatin aggregation agents containing a sulfo group) and/or couplers for incorporated-coupler type color sensitive materials.

A further characteristic of the present invention is that substantially no decrease in the spectral sensitivity occurs with the supersensitizing combination of the present invention on leaving the emulsion or by storage of the photosensitive material before processing, even though color image forming couplers are included in the photographic emulsion occurs.

The present invention is illustrated in greater detail by referrence to the following examples. However, the present invention is not to be construed as being limited to these examples, and they are given only to illustrate typical examples of the present invention. Unless otherwise indicated herein, all parts, percents, ratios and the like are by weight.

EXAMPLE 1

Silver halide photographic emulsions were produced by adding sensitizing dyes individually or as a combination to silver iodobromide emulsions (AgI : AgBr = 7 mol% : 93 mol%, gelatin (g)/$AgNO_3$(g) = 1.3, 0.53 mols of silver salt/Kg of emulsion). The average particle size of the silver halide particles was 0.70 microns. These emulsions were each coated on cellulose triacetate film supports and dried. Then the films were exposed (for 1/50 second) to a step wedge through a SC-46 Filter produced by the Fuji Photo Film Co., Ltd. (a yellow filter through which light having wavelengths longer than 460 nm passes, which has the spectral transmittance shown in the figure) with using a daylight source of 64 luxes (corresonding to a color temperature of 5400°K), developed at 20°C for 6 minutes using a developer having the following composition, stopped, fixed, rinsed and dried.

| Developer Composition | |
|---|---|
| Metol | 2 g |
| Sodium Sulfite (anhydrous) | 40 g |
| Hydroquinone | 4 g |
| Sodium Carbonate (monohydrate) | 28 g |
| Potassium Bromide | 1 g |

-continued

| Developer Composition | |
|---|---|
| Water to make | 1 liter |

Then, the densities of these films were measured using a P-type densitometer produced by the Fuji Photo Film Co., Ltd. to determine the sensitivities and fog. In order to determine the sensitivity, the standard optical density was set to fog + 0.10 and the sensitivity was shown as the reciprocal of the required exosure to achieve such. The results obtained are shown in Table 1 as relative values on the basis of Test No. 2.

Table 1

| Test No. | Sensitizing Dye and Amount | | | | Relative Sensitivity | Fog |
|---|---|---|---|---|---|---|
| | (× $10^{-5}$ mols/mol of silver halide) | | | | | |
| 1 | I - 4 | (1.7) | | | 85.1 | 0.09 |
| 2 | " | (3.4) | | | 100 | 0.09 |
| 3 | " | (6.8) | | | 95.5 | 0.10 |
| 4 | II - 6 | (1.7) | | | 83.2 | 0.08 |
| 5 | " | (3.4) | | | 95.5 | 0.08 |
| 6 | " | (6.8) | | | 89.1 | 0.09 |
| 7 | I - 4 | (1.7) | II - 6 | (5.1) | 135 | 0.09 |
| 8 | " | (3.4) | " | (3.4) | 141 | 0.09 |
| 9 | " | (5.1) | " | (1.7) | 148 | 0.10 |
| 10 | II - 2 | (1.7) | | | 79.4 | 0.12 |
| 11 | " | (3.4) | | | 81.3 | 0.12 |
| 12 | " | (6.8) | | | 81.3 | 0.13 |
| 13 | I - 4 | (1.7) | II - 2 | (5.1) | 141 | 0.12 |
| 14 | " | (3.4) | " | (3.4) | 151 | 0.12 |
| 15 | " | (5.1) | " | (1.7) | 151 | 0.12 |

It can be understood from the results in Table 1 that excellent supersensitization was obtained.

EXAMPLE 2

Dyes in the amounts shown in Table 2 were added to silver bromochloride photographic emulsion (Br: 90 mol%, Cl: 10 mol%; amount of gelatin per mol of silver: 170 g; containing 0.43 mols of silver per Kg of emulsion) containing α-(4-palmitoamidophenoxy)-α-pivaloyl-4-sulfoamylacetanilide (as described in U.S. Pat. No. 3,408,194) as a yellow dye image forming coupler. These emulsions were each coated on a sheet of photographic paper coated with a polyethylene film, and dried. Each coated sample was exposed to a step wedge for 1 second through a SC-46 filter produced by the Fuji Photo Film Co., Ltd. with using a tungsten lamp (having a color temperature of 2854°k), and processed by the following color development.

| Processing Step | Temperature | Time |
|---|---|---|
| Color Development | 30°C | 6 minutes |
| Stopping | " | 2 minutes |
| Water Wash | " | 2 minutes |
| Bleach-Fixing | " | 1 minute and 30 seconds |
| Water Wash | " | 2 minutes |
| Stabilizing | " | 2 minutes |
| Drying | " | |

The processing solutions had the following composition.

| Color Developer: | | |
|---|---|---|
| Benzyl Alcohol | 12 | ml |
| Diethylene Glycol | 3.5 | ml |
| Sodium Hydroxide | 2.0 | g |
| Sodium Sulfite | 2.0 | g |

-continued

| | | |
|---|---|---|
| Potassium Bromide | 0.4 | g |
| Sodium Chloride | 1.0 | g |
| Borax | 4.0 | g |
| Hydroxylamine Sulfate | 2.0 | g |
| Disodium Ethylenediamine Tetraacetate (dihydrate) | 2.0 | g |
| 4-Amino-3-methyl-N-ethyl-N-(β-methane-sulfonamidoethyl)aniline Sesquisulfate (monohydrate) | 5.0 | g |
| Water to make | 1 | liter |
| Stopping Solution: | | |
| Sodium Thiosulfate | 10 | g |
| Ammonium Thiosulfate (70% aq. soln.) | 30 | cc |
| Sodium Acetate | 5 | g |
| Acetic Acid | 30 | cc |
| Potassium Alum | 15 | g |
| Water to make | 1 | liter |
| Bleach-Fixing Solution | | |
| Ferric Sulfate | 20 | g |
| Disodium Ethylenediamine Tetraacetate (dihydrate) | 36 | g |
| Sodium Carbonate (monohydrate) | 17 | g |
| Sodium Sulfate | 5 | g |
| Ammonium Thiosulfate (70% aq. soln.) | 100 | ml |
| Boric Acid | 5 | g |
| pH adjusted to | 6.8 | |
| Water to make | 1 | liter |
| Stabilizing Solution: | | |
| Boric Acid | 5 | g |
| Sodium Citrate | 5 | g |
| Sodium Metaborate(tetrahydrate) | 3 | g |
| Potassium Alum | 15 | g |
| Water to make | 1 | liter |

Then the densities of the samples were measured with using a P-type densitometer produced by the Fuji Photo Film Co., Ltd. to determine the sensitivities and fog. In order to determine the sensitivity, an optical density as a standard was set at fog + 0.5, and the sensitivity was shown as the reciprocal of the required exposure to achieve such. The results obtained are shown in Table 2 as relative values on the basis of Test No. 20.

In Table 2, the degree of residual color is shown by "slight", "very low" and "none".

Table 2

| Test No. | Sensitizing Dye and Amount | | | | Relative Sensitivity | Fog | Residual Color |
|---|---|---|---|---|---|---|---|
| | | (× $10^{-5}$ mols/mol of silver halide) | | | | | |
| 19 | I - 1 | (1.7) | | | 67.6 | 0.05 | None |
| 20 | " | (3.4) | | | 100 | 0.05 | " |
| 21 | " | (6.8) | | | 89.1 | 0.05 | " |
| 22 | II - 1 | (1.7) | | | 72.4 | 0.05 | " |
| 23 | " | (3.4) | | | 89.1 | 0.05 | " |
| 24 | " | (6.8) | | | 69.1 | 0.05 | Very low |
| 25 | I - 1 | (1.7) | II - 1 | (5.1) | 120 | 0.05 | None |
| 26 | " | (3.4) | " | (3.4) | 136 | 0.05 | " |
| 27 | " | (5.1) | " | (1.7) | 132 | 0.05 | " |
| 28 | II - 3 | (1.7) | | | 85.0 | 0.05 | Very low |
| 29 | " | (3.4) | | | 97.5 | 0.05 | " |
| 30 | " | (6.8) | | | 93.0 | 0.05 | Slight |
| 31 | I - 1 | (1.7) | II - 3 | (5.1) | 123 | 0.05 | Very low |
| 32 | " | (3.4) | " | (3.4) | 129 | 0.05 | " |
| 33 | " | (5.1) | " | (1.7) | 126 | 0.05 | None |
| 34 | II - 2 | (1.7) | | | 45.6 | 0.05 | " |
| 35 | " | (3.4) | | | 48.9 | 0.05 | Very low |
| 36 | " | (6.8) | | | 43.5 | 0.05 | Slight |
| 37 | I - 1 | (1.7) | II - 2 | (5.1) | 117 | 0.05 | Very low |
| 38 | " | (3.4) | " | (3.4) | 120 | 0.05 | " |
| 39 | " | (5.1) | " | (1.7) | 120 | 0.05 | None |
| 40 | I - 2 | (1.7) | | | 81.1 | 0.06 | None |
| 41 | " | (3.4) | | | 100 | 0.06 | Very low |
| 42 | " | (5.1) | | | 93.1 | 0.06 | Slight |
| 43 | II - 4 | (1.7) | | | 79.5 | 0.05 | None |
| 44 | " | (3.4) | | | 89.0 | 0.05 | " |
| 45 | " | (5.1) | | | 85.0 | 0.05 | " |
| 46 | I - 2 | (1.7) | II - 4 | (5.1) | 120 | 0.05 | " |
| 47 | " | (3.4) | " | (3.4) | 132 | 0.05 | Very low |

Table 2-continued

| Test No. | Sensitizing Dye and Amount | | | | Relative Sensitivity | Fog | Residual Color |
|---|---|---|---|---|---|---|---|
| 48 | " | (5.1) | " | (1.7) | 126 | 0.06 | " |

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing at least one sensitizing dye represented by the formula (I)

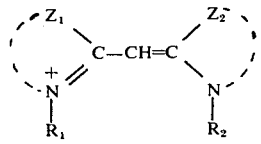

(I)

wherein $Z_1$ represents a group of atoms necessary to complete a thiazole nucleus, a benzothiazole nucleus, a benzoselenazole nucleus, a naphthothiazole nucleus or a naphthoselenazole nucleus; $Z_2$ represents a group of atoms necessary to complete a naphthothiazole nucleus or a naphthoselenazole nucleus; and $R_1$ and $R_2$, which may be the same or different, each represents an aliphatic group and at least one of $R_1$ and $R_2$ is an aliphatic group containing a carboxyl group or a sulfo group; and at least one sensitizing dye represented by the formula (II)

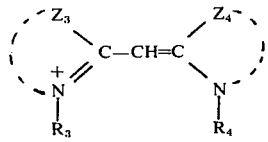

(II)

wherein $Z_3$ and $Z_4$ which may be the same or different, each represents a group of atoms necessary to complete a thiazole nucleus, a benzothiazole nucleus or a benzoselenazole nucleus; and $R_3$ and $R_4$, which may be the same or different, each represents an aliphatic group and at least one of $R_3$ and $R_4$ is an aliphatic group containing a carboxyl group or a sulfo group.

2. The silver halide photographic emulsion of claim 1, wherein said sensitizing dye of the formula (I) has the formula (III)

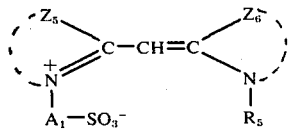

(III)

wherein $Z_5$ represents a group of atoms necessary to complete a benzothiazole nucleus or a naphthiazole nucleus; $Z_6$ represents a group of atoms necessary to complete a naphthothiazole nucleus; $A_1$ represents an alkylene group having 4 or less carbon atoms which can be substituted with a hydroxyl group; $R_5$ represents an $—A_2—SO_3H$ group or an $—A_2—CO_2H$ group, wherein $A_2$ has the same meaning as $A_1$, and $A_2$ and $A_1$ can be the same or different.

3. The silver halide photographic emulsion of claim 1, wherein said sensitizing dye of the formula (II) has the formula (V)

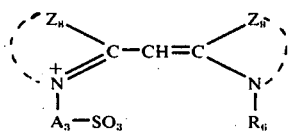

(V)

wherein $Z_8$ and $Z_9$, which may be the same or different, each represents a group of atoms necessary to complete a benzothiazole nucleus or a benzoselenazole nucleus; $A_3$ represents an alkylene group having 4 or less carbon atoms which can be substituted with a hydroxyl group; $R_6$ represents an $—A_4—SO_3H$ group or an $—A_4—CO_2H$ group, wherein $A_4$ has the same meaning as $A_3$, and $A_4$ and $A_3$ can be the same or different.

4. The silver halide photographic emulsion as set forth in claim 1, wherein said sensitizing dye of the formula (I) has the formula (III)

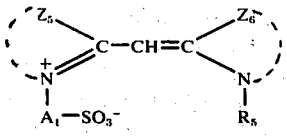

(III)

wherein $Z_5$ represents a group of atoms necessary to complete a benzothiazole nucleus or a naphthothiazole nucleus; $A_1$ represents an alkylene group having 4 or less carbon atoms which can be substituted with a hydroxyl group; $R_5$ represents an $—A_2—SO_3H$ group or an $—A_2—CO_2H$ group, wherein $A_2$ has a same meaning as $A_1$, and $A_2$ and $A_1$ can be the same or different; and said sensitizing dye of the formula (II) has the formula (V)

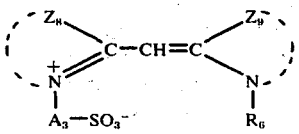

(V)

wherein $Z_8$ and $Z_9$, which may be the same or different, each represents a group of atoms necessary to complete a benzothiazole nucleus or a benzoselenazole nucleus; $A_3$ represents an alkylene group having 4 or less carbon atoms which can be substituted with a hydroxyl group; $R_6$ represents an $—A_4—SO_3H$ group or an $—A_4—CO_2H$ group, wherein $A_4$ has the same meaning as $A_3$, and $A_4$ and $A_3$ can be the same or different.

5. The silver halide photographic emulsion of claim 1, wherein said dye of the formula (I) has the formula (IV)

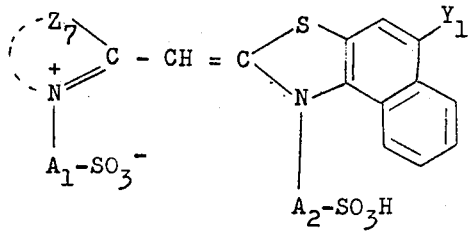

(IV)

wherein $Z_7$ represents a group of atoms necessary to complete a benzothiazole nucleus or a naphtho(1,2-d)thiazole nucleus; $A_1$ represents an alkylene group having 4 or less carbon atoms which can be substituted with a hydroxyl group; and $A_2$ has the same meaning as $A_1$, and $A_2$ and $A_1$ can be the same or different; and the sensitizing dye of the formula (II) has the formula (V)

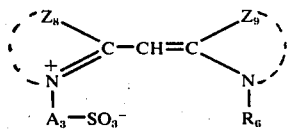

(V)

wherein $Z_8$ and $Z_9$, which can be the same or different, each represents a group of atoms necessary to complete a benzothiazole nucleus or a benzoselenazole nucleus; $A_3$ represents an alkylene group having 4 or less carbon atoms which can be substituted with a hydroxyl group; $R_6$ represents an $—A_4—SO_3H$ group or an $—A_4—CO_2H$ group, and $A_4$ has the same meaning as $A_3$, and $A_4$ and $A_3$ can be the same or different.

6. The silver halide photographic emulsion as set forth in claim 1, wherein said sensitizing dye having the formula (I) has the formula (III)

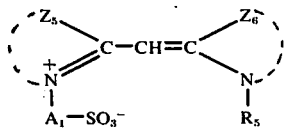

(III)

wherein $Z_5$ represents a group of atoms necessary to complete a benzothiazole nucleus or a naphthothiazole nucleus; $A_1$ represents an alkylene group having 4 or less carbon atoms which can be substituted with a hydroxyl group; $R_5$ represents an $—A_2—SO_3H$ group or an $—A_2—CO_2H$ group, wherein $A_2$ has a same meaning as $A_1$, and $A_2$ and $A_1$ can be the same or different; and said sensitizing dye represented by the formula (II) has the formula (VI)

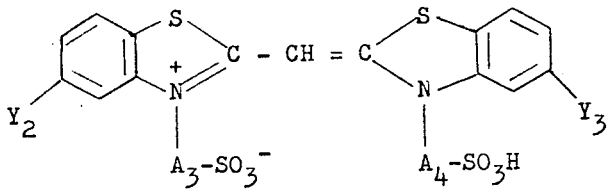

(VI)

wherein $Y_2$ and $Y_3$, which may be the same or different, each represents a hydrogen atom, an alkyl group, a halogen atom, an aryl group, or a hydrogen atom, with the proviso that $Y_2$ and $Y_3$ are not both simultaneously a hydrogen atom; $A_3$ represents an alkylene group having 4 or less carbon atoms which can be substituted with a hydroxyl group; and $A_4$ has the same meaning as $A_3$, and $A_4$ and $A_3$ can be the same or different.

7. The silver halide photographic emulsion as set forth in claim 1, wherein said sensitizing dye of the formula (I) has the formula (IV)

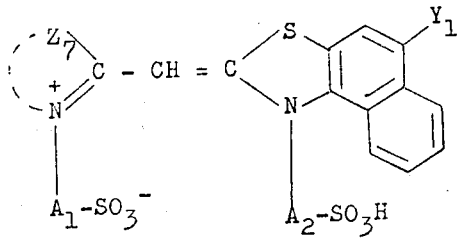

(IV)

wherein $Z_7$ represents a group of atoms necessary to complete a benzothiazole nucleus or a naphtho(1,2-d)thiazole nucleus; $A_1$ represents an alkylene group having 4 or less carbon atoms which can be substituted with a hydroxyl group; and $A_2$ has the same meaning as $A_1$, and $A_2$ and $A_1$ can be the same or different; and said sensitizing dye of the formula (II) has the formula (VI)

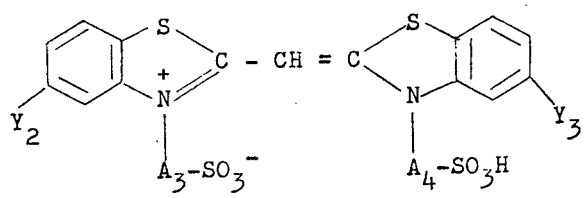

(VI)

wherein $Y_2$ and $Y_3$, which may be the same or different, each represents a hydrogen atom, an alkyl group, a halogen atom, an aryl group, or a hydrogen atom, with the proviso that $Y_2$ and $Y_3$ are not both simultaneously a hydrogen atom; $A_3$ represents an alkylene group having 4 or less carbon atoms which can be substituted with a hydroxyl group; and $A_4$ has the same meaning as $A_3$, and $A_4$ and $A_3$ can be the same or different.

8. The silver halide photographic emulsion as set forth in claim 5, wherein $A_1$ and $A_2$ each represents an unsubstituted alkylene group.

9. The silver halide photographic emulsion as set forth in claim 5, wherein $A_3$ and $A_4$ each represents an unsubstituted alkylene group.

10. The silver halide photographic emulsion as set forth in claim 7, wherein $A_1$, $A_2$, $A_3$ and $A_4$ each represents an unsubstituted alkylene group.

11. The silver halide photographic emulsion as set forth in claim 1, wherein said sensitizing dye represented by the formula (I) and said sensitizing dye represented by the formula (II) are present in an amount ranging from about $2 \times 10^{-6}$ moles to about $1 \times 10^{-3}$ moles.

12. The silver halide photographic emulsion as set forth in claim 11, wherein the dye represented by the formula (I) and the dye represented by the formula (II) are present in a molar ratio of from about 1:10 to about 10:1.

13. The silver halide photographic emulsion as set forth in claim 1, wherein said emulsion includes a yellow-forming coupler.

14. The silver halide photographic emulsion as set forth in claim 4, wherein said emulsion includes a yellow forming coupler.

15. The silver halide photographic emulsion as set forth in claim 7, wherein said emulsion includes a yellow forming coupler.

16. A photographic light sensitive material comprising a support having thereon at least one photographic light-sensitive layer comprising the photographic emulsion as set forth in claim 1.

17. A color photographic light-sensitive material comprising a support having thereon at least two light-sensitive silver halide emulsions, wherein at least one of said silver halide emulsion layer contains a color coupler and at least one of said layers comprises the photographic emulsion as set forth in claim 1.

* * * * *